US011896118B2

(12) United States Patent
Choi

(10) Patent No.: US 11,896,118 B2
(45) Date of Patent: Feb. 13, 2024

(54) EXTENDABLE FRAME AND STRUCTURE HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

(21) Appl. No.: 17/843,107

(22) Filed: Jun. 17, 2022

(65) Prior Publication Data

US 2022/0400845 A1 Dec. 22, 2022

(30) Foreign Application Priority Data

Jun. 21, 2021 (CN) ..... 202121381388.6

(51) Int. Cl.

| | |
|---|---|
| ***A47B 1/08*** | (2006.01) |
| ***A47B 1/02*** | (2006.01) |
| ***A47B 1/10*** | (2006.01) |
| ***A47B 3/00*** | (2006.01) |

(52) U.S. Cl.

CPC ..... *A47B 1/08* (2013.01); *A47B 1/02* (2013.01); *A47B 1/10* (2013.01); *A47B 3/002* (2013.01); *A47B 2003/006* (2013.01)

(58) Field of Classification Search

CPC .... A47B 1/08; A47B 1/10; A47B 1/02; A47B 3/02; A47B 3/002; A47B 3/08

See application file for complete search history.

(56) References Cited

U.S. PATENT DOCUMENTS

| | | | | |
|---|---|---|---|---|
| 5,735,220 | A * | 4/1998 | Wang | A47B 1/10 108/87 |
| 9,622,568 | B1 * | 4/2017 | Lin | A47B 13/081 |
| 11,686,429 | B2 * | 6/2023 | Choi | F16M 11/38 248/166 |
| 2007/0006784 | A1 * | 1/2007 | Thrush | A47B 3/0912 108/129 |
| 2020/0093256 | A1 * | 3/2020 | Mansson | A47B 13/023 |
| 2022/0142352 | A1 * | 5/2022 | Pernet | A47B 1/02 |
| 2022/0265037 | A1 * | 8/2022 | Choi | A47B 3/087 |
| 2022/0287450 | A1 * | 9/2022 | Benard | A47B 1/10 |
| 2022/0338615 | A1 * | 10/2022 | Andersson | A47B 1/02 |
| 2023/0157444 | A1 * | 5/2023 | Jiang | A47B 3/002 108/42 |

* cited by examiner

*Primary Examiner* — Daniel J Rohrhoff

(74) *Attorney, Agent, or Firm* — MORGAN, LEWIS & BOCKIUS LLP

(57) ABSTRACT

A supporting frame includes a mounting assembly and a plurality of leg assemblies to support the mounting assembly. The mounting assembly includes first and second mounting units, at least one of which is extendable in a longitudinal or lateral direction of the mounting assembly. In some cases, the first and second mounting units are pivotally connected to each other and each of the leg assemblies is foldable relative to the first or second mounting unit, resulting in an extendable and foldable supporting frame. A supporting structure includes a supporting frame and first and second panels connected to the supporting frame. In some cases, the supporting structure is foldable in half.

20 Claims, 15 Drawing Sheets

EXTENDABLE FRAME AND STRUCTURE HAVING SAME

CROSS-REFERENCE TO RELATED APPLICATIONS

The present application claims priority to Chinese Utility Model Application CN 202121381388.6 filed Jun. 21, 2021, the disclosure of which is incorporated herein for all purposes by reference in its entirety.

FIELD OF THE INVENTION

The present invention generally relates to extendable frames and structures, and in particular, to extendable and foldable frames and structures.

BACKGROUND

Foldable tables are popular because they require less storage space and are easy to carry around. An existing foldable table generally includes two panels coupled to a supporting frame. However, many exiting foldable tables are non-extendable and thus have fixed usable areas. As such, to meet different needs or preferences, users often need to buy multiple tables of different sizes and select a table according to the situation. This is uneconomical and inconvenient.

Given the current state of the art, there remains a need for supporting frames and tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides extendable supporting frames and structures with adjustable usable areas.

In various exemplary embodiments, the present disclosure provides a supporting frame including a mounting assembly and a plurality of leg assemblies. The mounting assembly includes a first mounting unit and a second mounting unit. Each of the first and second mounting units includes a first longitudinal mounting member and a second longitudinal mounting member spaced apart from each other in a first direction. Each of the first and second longitudinal mounting members of the first and second mounting units has a length that is adjustable in a second direction, thereby allowing the mounting assembly to extend or contract in the second direction. The first longitudinal mounting members of the first and second mounting units are pivotally coupled with each other at their proximal end portions and the second longitudinal mounting members of the first and second mounting units are pivotally coupled with each other at their proximal end portions, thereby allowing the first and second mounting units to rotate relative to each other between a folded position and an unfolded position. Each of the plurality of leg assemblies is connected to the mounting assembly and rotatable relative to the first and second longitudinal mounting members of the first or second mounting unit, thereby allowing the mounting assembly and the plurality of leg assemblies to fold onto each other. The resultant supporting frame is extendable and foldable.

In some exemplary embodiments, each respective longitudinal mounting member in the first and second longitudinal mounting members of the first and second mounting units includes a first elongated member and a second elongated member telescopically coupled with each other.

In some exemplary embodiments, each respective longitudinal mounting member further includes a first engaging member and a second engaging member. The first engaging member is disposed at the first elongated member, and the second engaging member is disposed at the second elongated member. When engaged with each other, the first and second engaging members collectively prevent the respective longitudinal mounting member from extending beyond a defined maximal allowable length of the respective longitudinal mounting member.

In some exemplary embodiments, at least a portion of the first elongated member is tubular. The first engaging member is connected to a first end portion of the first elongated member and includes a slot matching, cross-sectional-wise, the second elongated member to guide telescopic movement of the second elongated member with respect to the first elongated member.

In an exemplary embodiment, an end portion of the second elongated member of the first or second longitudinal mounting member of the first mounting unit is pivotally connected to an end portion of the second elongated member of the first or second longitudinal mounting member of the second mounting unit.

In some exemplary embodiments, the second elongated member includes a rail portion and a bearing portion.

In an exemplary embodiment, cross-sectional-wise, the railing and bearing portions collectively form a substantially "L" shape.

In some exemplary embodiments, the second engaging member is disposed at the bearing portion of the second elongated member.

In some exemplary embodiments, the plurality of leg assembles includes a first leg assembly and a second leg assembly. The first leg assembly is connected to the first mounting unit and rotatable with respect to the first and second longitudinal mounting members of the first mounting unit. The second leg assembly is connected to the second mounting unit and rotatable with respect to the first and second longitudinal mounting members of the second mounting unit.

In an exemplary embodiment, each of the first and second mounting units further includes a lateral mounting member rotatably connected to the first and second longitudinal mounting members of the first or second mounting unit at their distal end portions. The first or second leg assembly is connected to the lateral mounting member of the first or second mounting unit.

In some exemplary embodiments, the mounting assembly further includes an interior lateral mounting member connected to the first and second longitudinal mounting members of the first or second mounting unit at their proximal end portions. The plurality of leg assemblies further includes a third leg assembly connected to the interior lateral mounting member.

In various exemplary embodiments, the present disclosure provide a supporting frame including a mounting assembly. The mounting assembly includes a first mounting unit and a second mounting unit connected to each other at their proximal sides. Each of the first and second mounting units includes a first mounting member and a second member spaced apart from each other in a first direction. For at least one mounting unit in the first and second mounting units, each of the first and second mounting members includes a first elongated member, a second elongated member, a first engaging member and a second engaging member. The first and second elongated members are telescopically coupled with each other to adjust a length of the first or second mounting member in a second direction, thereby allowing the mounting assembly to extend or contract in the second direction. The first engaging member is disposed at the first elongated member and configured to guide telescopic movement of the second elongated member relative to the first elongated member. The second engaging member is disposed at the second elongated member and configured to engage with the first engaging member to prevent the first or second mounting member from extending beyond a defined maximal allowable length of the first or second mounting member.

In some exemplary embodiments, at least a portion of the first elongated member is tubular. The first engaging member is connected to a first end portion of the first elongated member and includes a slot matching, cross-sectional-wise, the second elongated member to guide telescopic movement of the second elongated member relative to the first elongated member.

In some exemplary embodiments, each of the first and second mounting members of the first and second mounting units includes the first and second elongated members. An end portion of the second engaging member of the first or second longitudinal mounting member of the first mounting unit is pivotally connected to an end portion of the second engaging member of the first or second longitudinal mounting member of the second mounting unit.

In an exemplary embodiment, the second elongated member includes a rail portion and a bearing portion. Cross-sectional-wise, the railing and bearing portions collectively form a substantially "L" shape.

In various exemplary embodiments, the present invention provides a supporting structure. The supporting structure includes a supporting frame disclosed herein, a first panel coupled with the first mounting unit, and a second panel coupled with the second mounting unit.

In various exemplary embodiments, the present invention provides a supporting structure including a mounting assembly, a plurality of leg assemblies, a first panel and a second panel. The mounting assembly includes a first mounting unit and a second mounting unit. Each of the first and second mounting units includes a first longitudinal mounting member and a second longitudinal mounting member spaced apart from each other in a first direction. Each of the first and second longitudinal mounting members of the first and second mounting units has a length that is adjustable in a second direction, thereby allowing the mounting assembly to extend or contract in the second direction. The first longitudinal mounting members of the first and second mounting units are pivotally coupled with each other at their proximal end portions and the second longitudinal mounting members of the first and second mounting units are pivotally coupled with each other at their proximal end portions, thereby allowing the first and second mounting units to rotate relative to each other between a folded position and an unfolded position. Each of the plurality of leg assemblies is connected to the mounting assembly and rotatable relative to the first and second longitudinal mounting members of the first or second mounting unit. The first panel is coupled with the first mounting unit, and the second panel is coupled with the second mounting unit. As such, the supporting structure is extendable and foldable. When folded, the mounting assembly and the plurality of leg assemblies are disposed between the first and second panels.

In some exemplary embodiments, the first mounting unit is substantially the same as the second mounting unit and the first panel is substantially the same as the second panel, thereby allowing the supporting structure to fold substantially in half.

In some exemplary embodiments, the supporting structure further includes a third panel detachably coupled with the first and second mounting units between the first and second panels when the mounting assembly is extended.

The supporting frames and structures (e.g., tables) of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of extendable supporting frames and structures. Generally, a supporting frame includes a mounting assembly that is extendable in a lateral or longitudinal direction of the supporting frame to facilitate adjustment of the size of the supporting frame. In some exemplary embodiments, a supporting frame includes a first mounting unit and a second mounting unit, with at least one of the first and second mounting units being extendable. In some exemplary embodiments, a supporting frame is also foldable. A supporting structure generally includes a supporting frame and first and second panels connected to the supporting frame. In some exemplary embodiments, the supporting structure is foldable in half.

Figure 1:
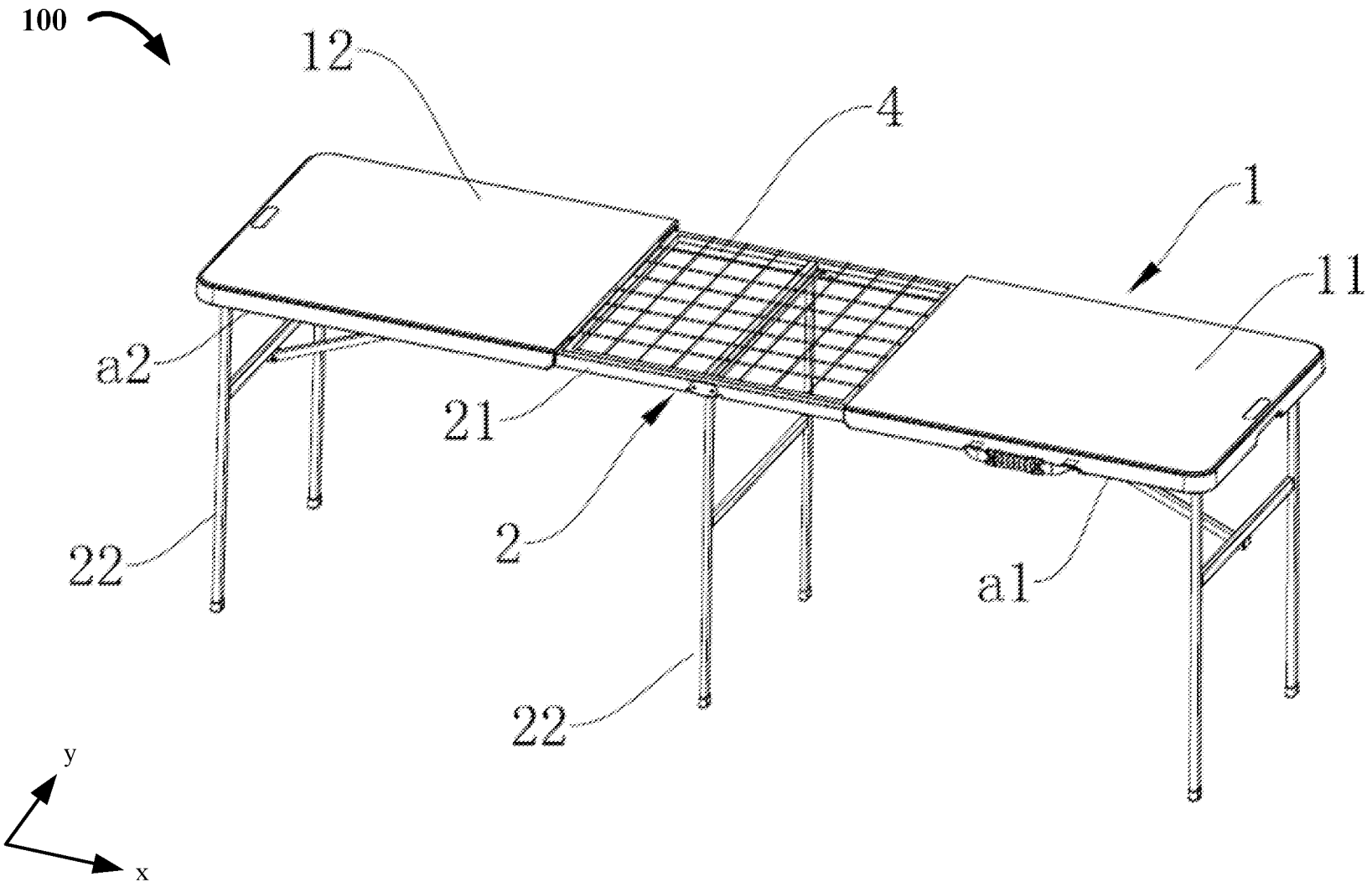
FIG. 1 is a top perspective view illustrating an exemplary structure in an extended state in accordance with some exemplary embodiments of the present disclosure.
Figure 2A:
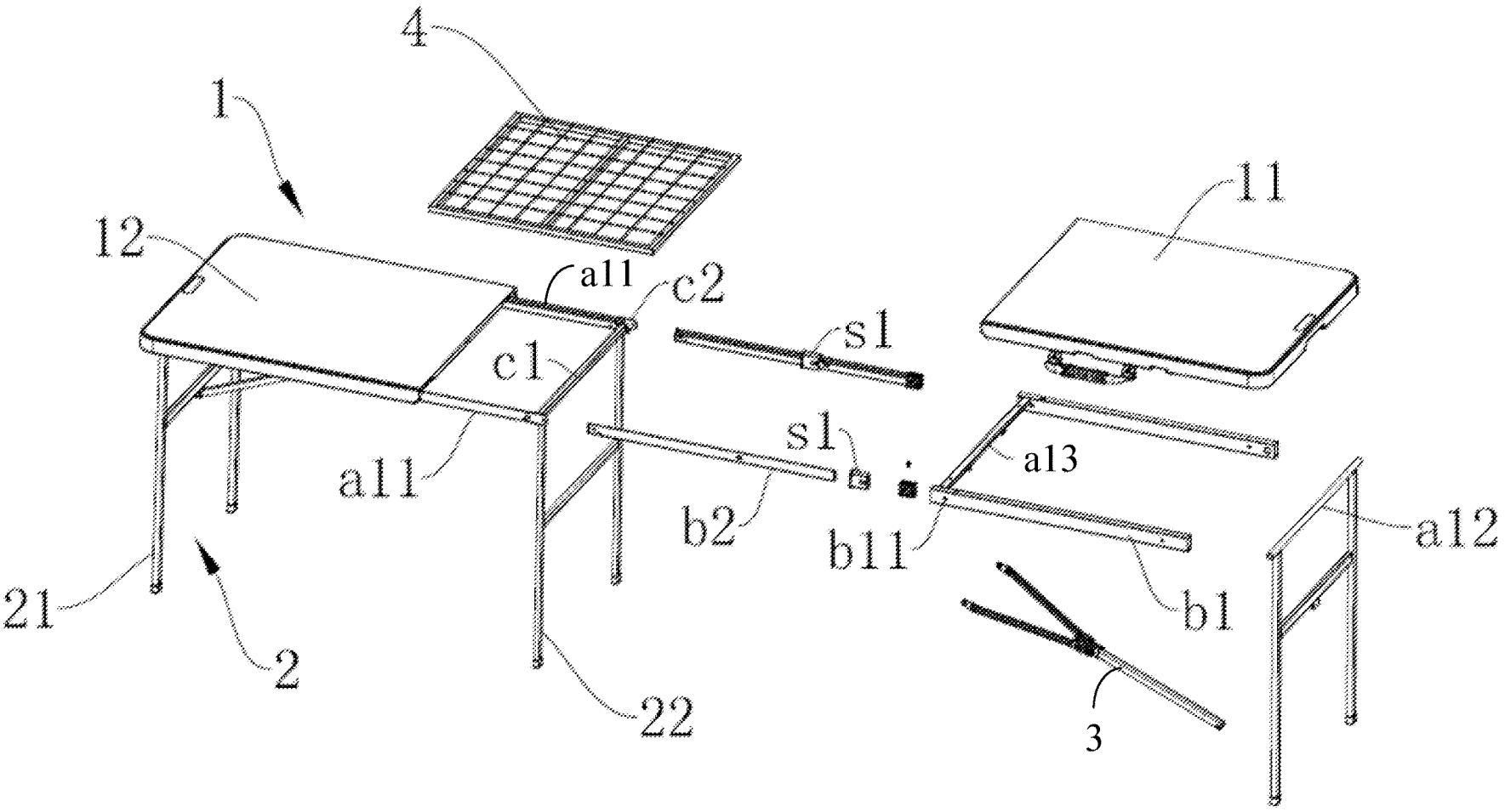
FIG. 2A is a partially disassembled view illustrating the exemplary structure of FIG. 1.
Figure 2B:
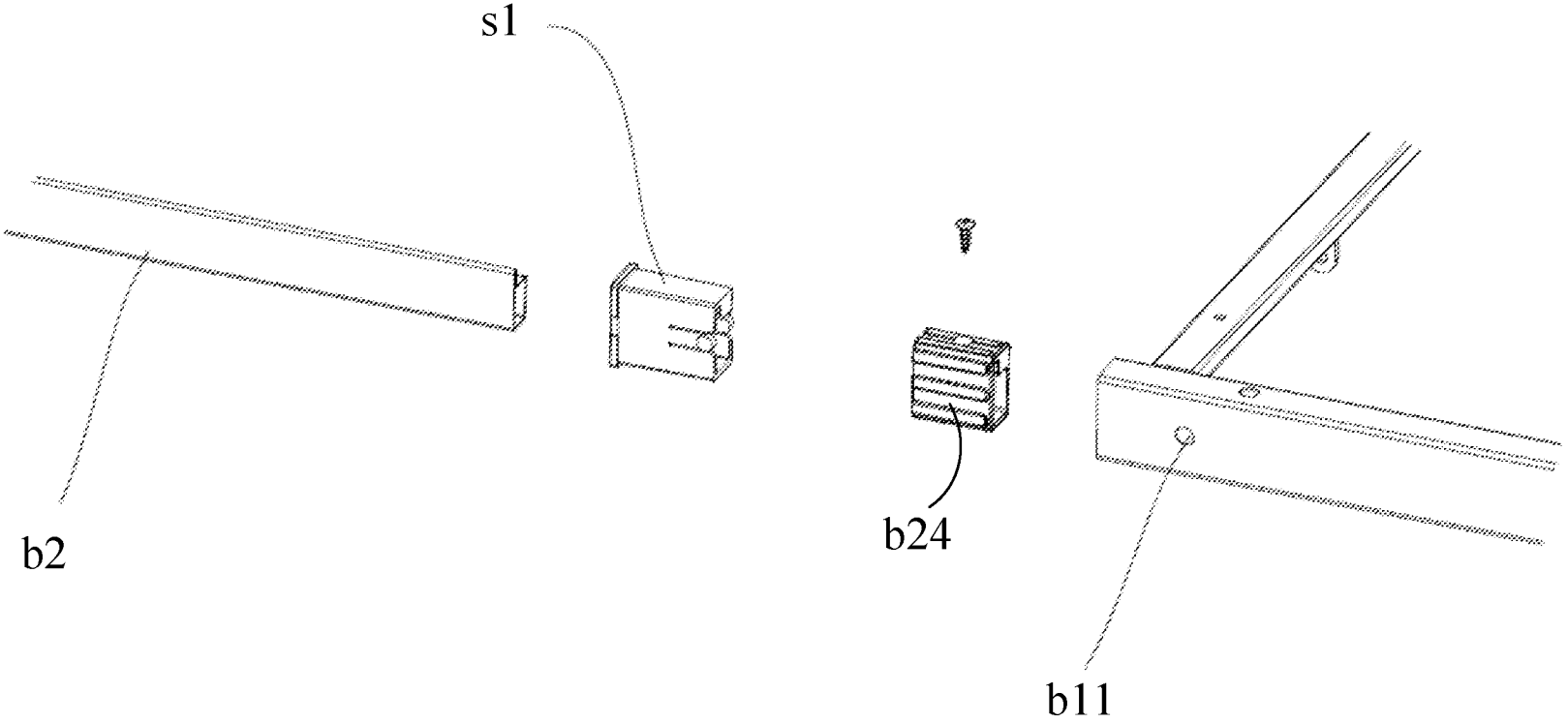
FIG. 2B is an enlarged view illustrating a portion of the exemplary structure of FIG. 2A.
Figure 3:
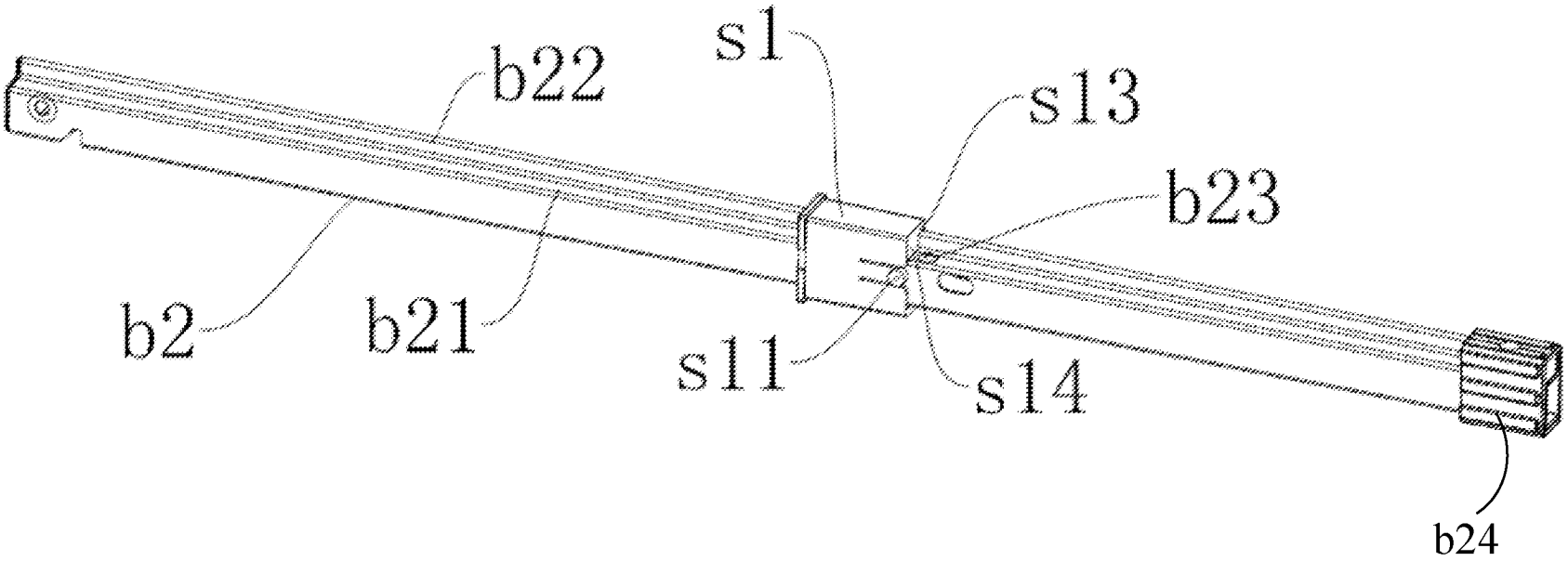
FIG. 3 is a perspective view illustrating an exemplary component of the exemplary structure of FIG. 1.

Referring now to FIGS. 1-3, there is depicted exemplary structure 100 in accordance with some exemplary embodiments of the present disclosure. The structure can be a table, a bench, or the like. As a non-limiting example, a table is illustrated. Structure 100 generally includes a panel assembly, such as panel assembly 1, and a supporting frame, such as supporting frame 2, to support the panel assembly.

The supporting frame includes a mounting assembly that is extendable in a lateral or longitudinal direction of the supporting frame. For instance, in some exemplary embodiments, the supporting frame include mounting assembly 21 configured to be extendable in the longitudinal direction, e.g., the x-direction in FIG. 1, of the supporting frame. For instance, in some exemplary embodiments, the mounting assembly includes a first mounting unit, such as mounting unit a1, and a second mounting unit, such as mounting unit a2, with at least one of the first and second mounting unit being extendable in the x-direction. In an exemplary embodiment, only one of the first and second mounting units is extendable in the x-direction. In another exemplary embodiment, each of the first and second mounting units is extendable in the x-direction. The first and second mounting units can be but do not necessarily have to be identical or symmetric with respect to each other. By way of example, FIG. 1 illustrates the first and second mounting units that are substantially the same and disposed symmetrically with respect to each other.

In some exemplary embodiments, the first and second mounting units are pivotally connected to each other, for instance, by connector c2, at their proximal sides. As used herein, the sides at which first and second mounting units are connected to each other are referred to as their proximal sides, and the sides opposite the proximal sides are referred to as their distal sides. For instance, in FIG. 1, the proximal sides of first and second mounting units are in the middle of the supporting frame. The distal sides correspond to the left and right sides of the figure. It should be noted that the term "middle" as used herein does not necessarily mean the center of the frame, and the term "side" does not necessarily mean an outmost edge of the frame.

Figure 4A:
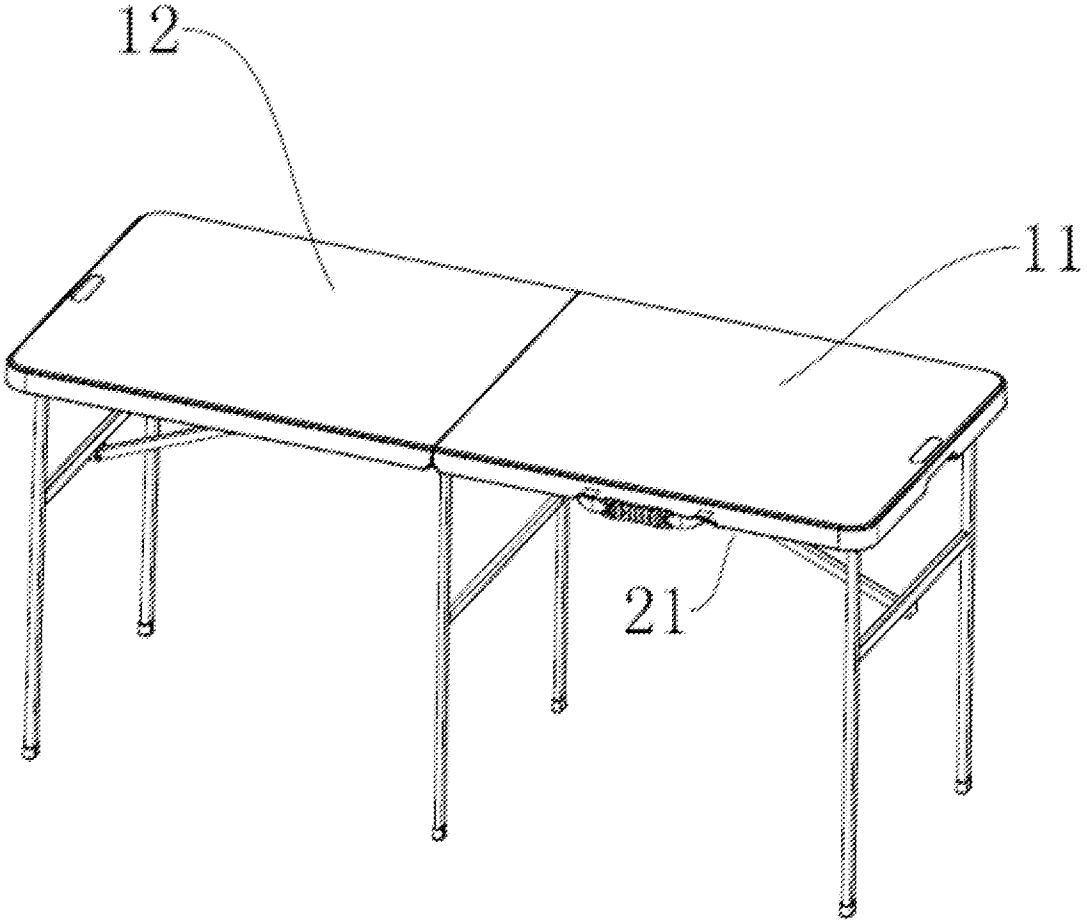
FIGS. 4A, 4B, 4C, 4D and 4E collectively illustrate an exemplary process for extending the exemplary structure of FIG. 1.
Figure 4B:
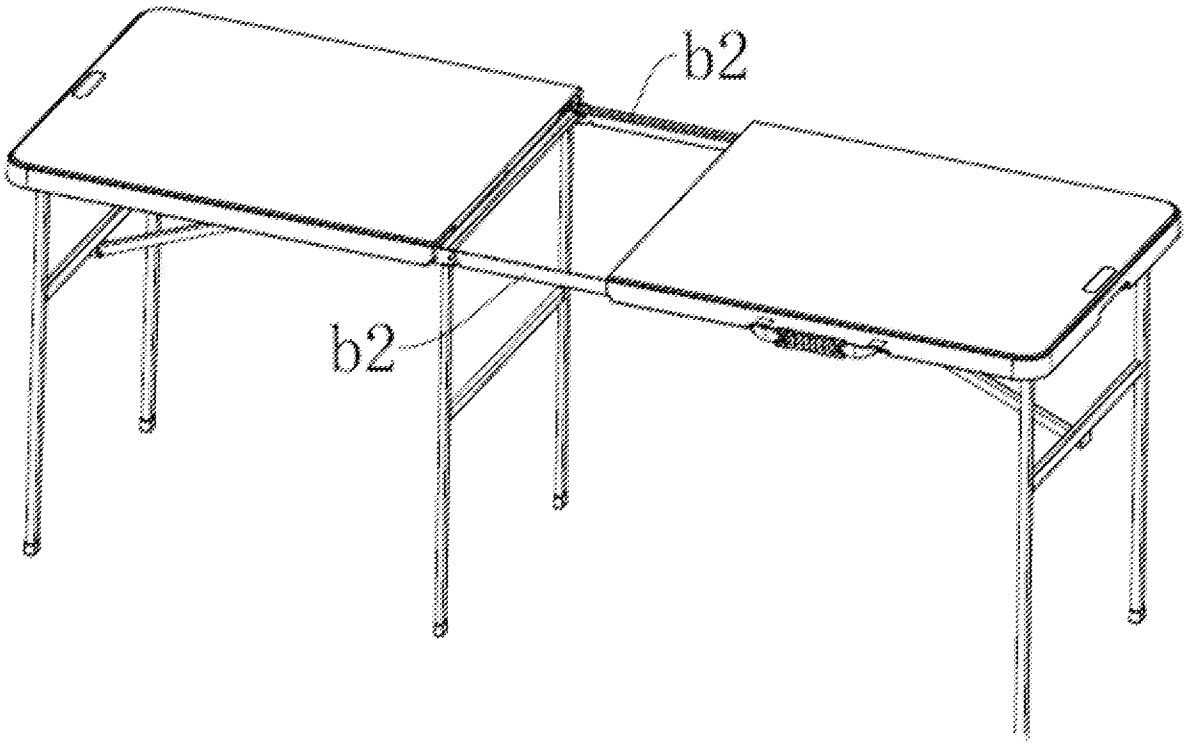
Figure 4C:
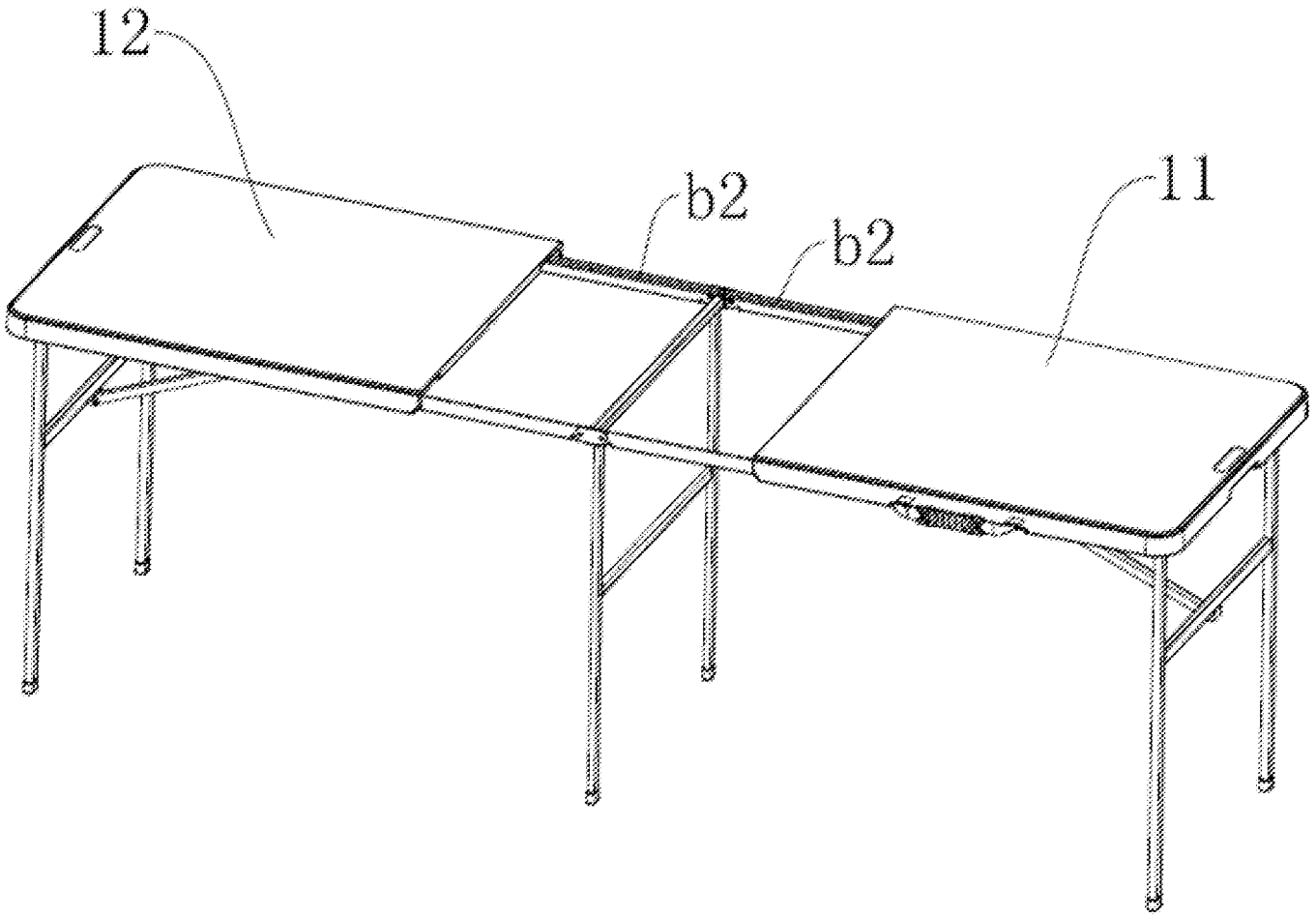
Figure 4D:
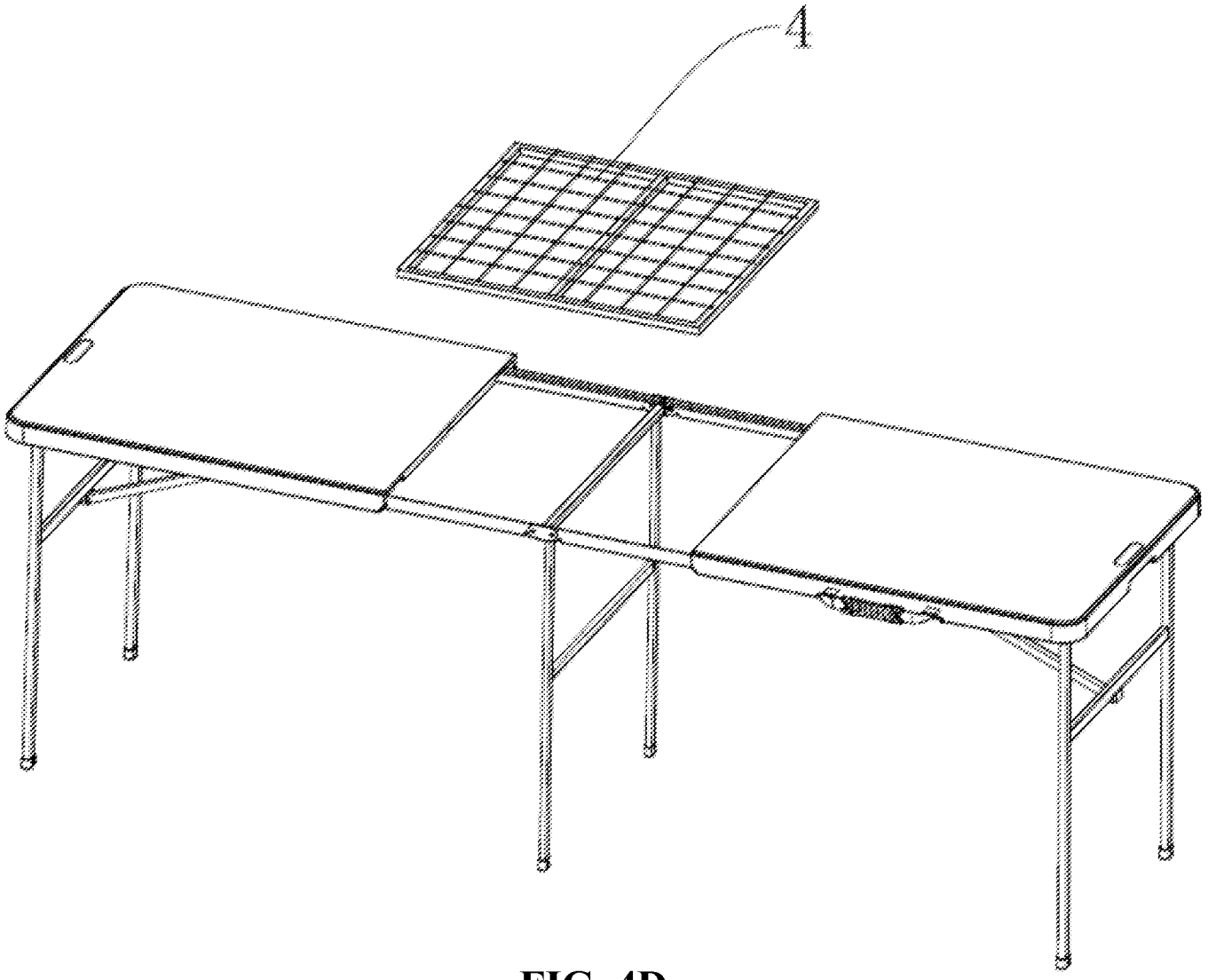
Figure 4E:
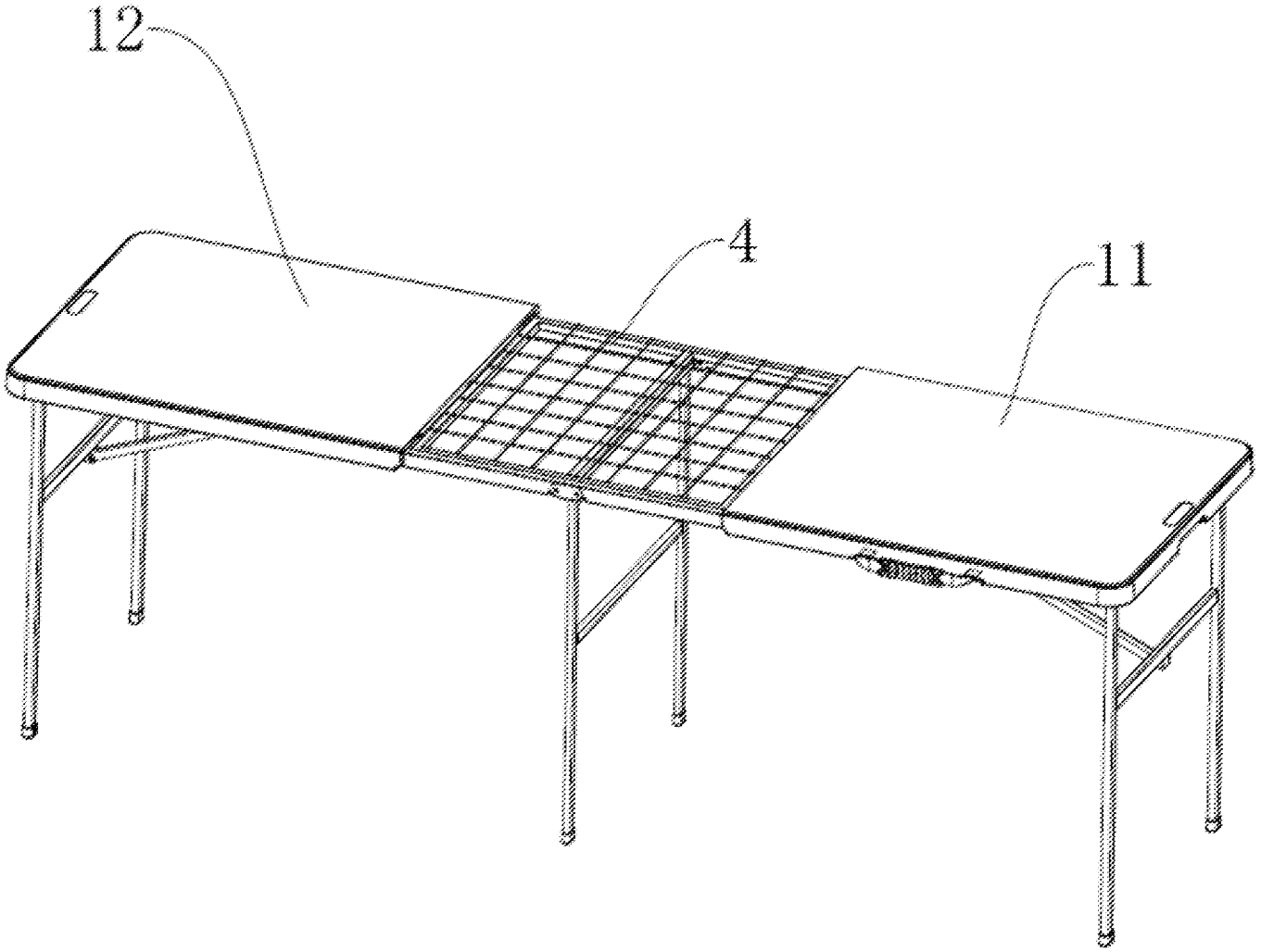
Figure 5A:
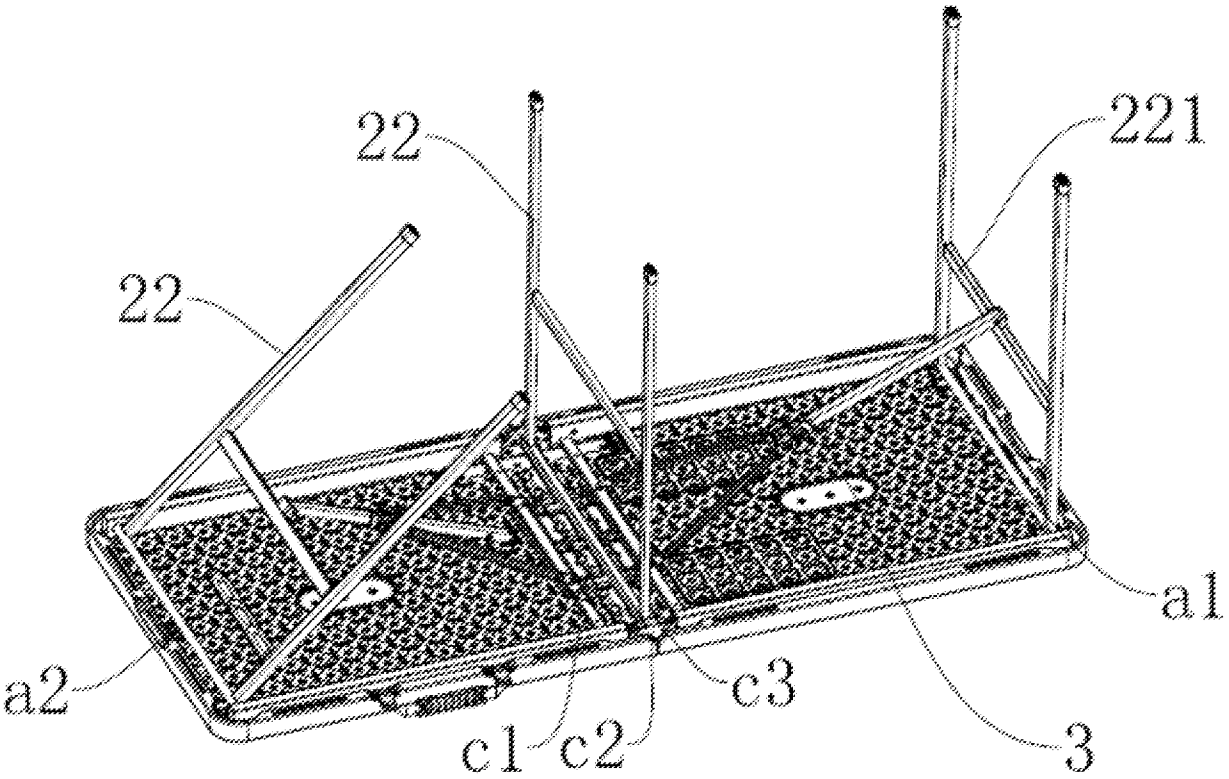
FIGS. 5A, 5B, 5C, 5D, 5E and 5F collectively illustrate an exemplary process for folding the exemplary structure of FIG. 1.
Figure 5B:
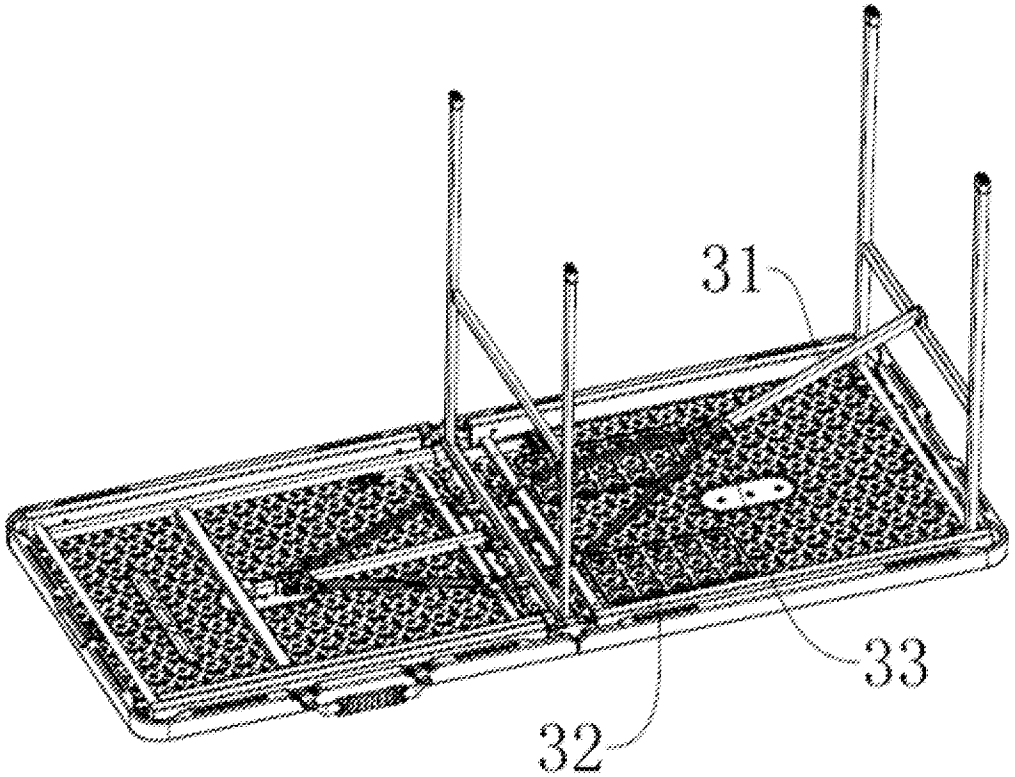
Figure 5C:
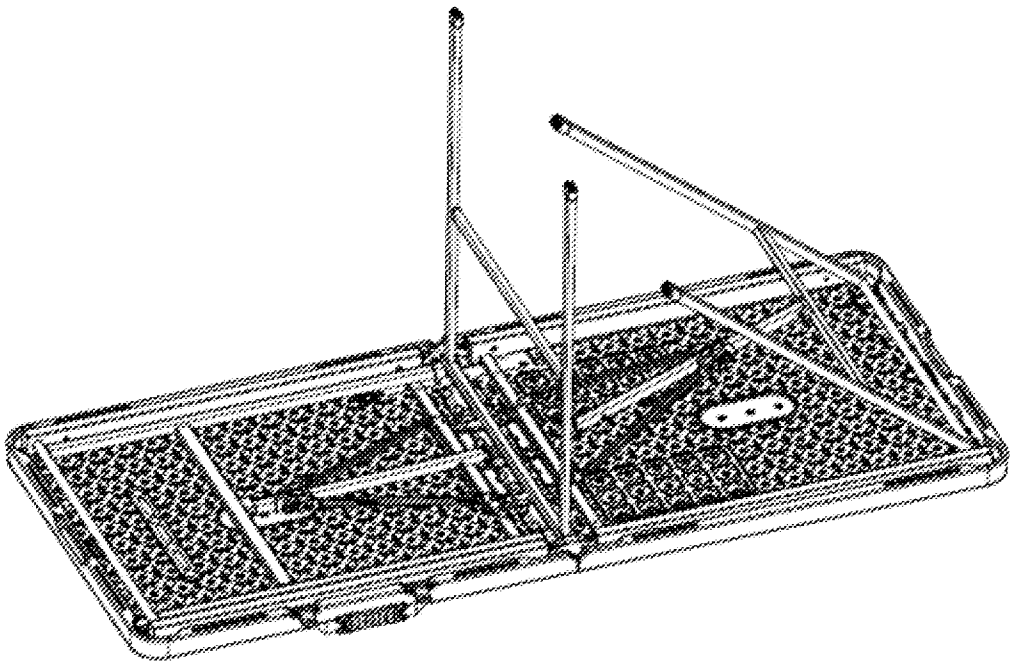
Figure 5D:
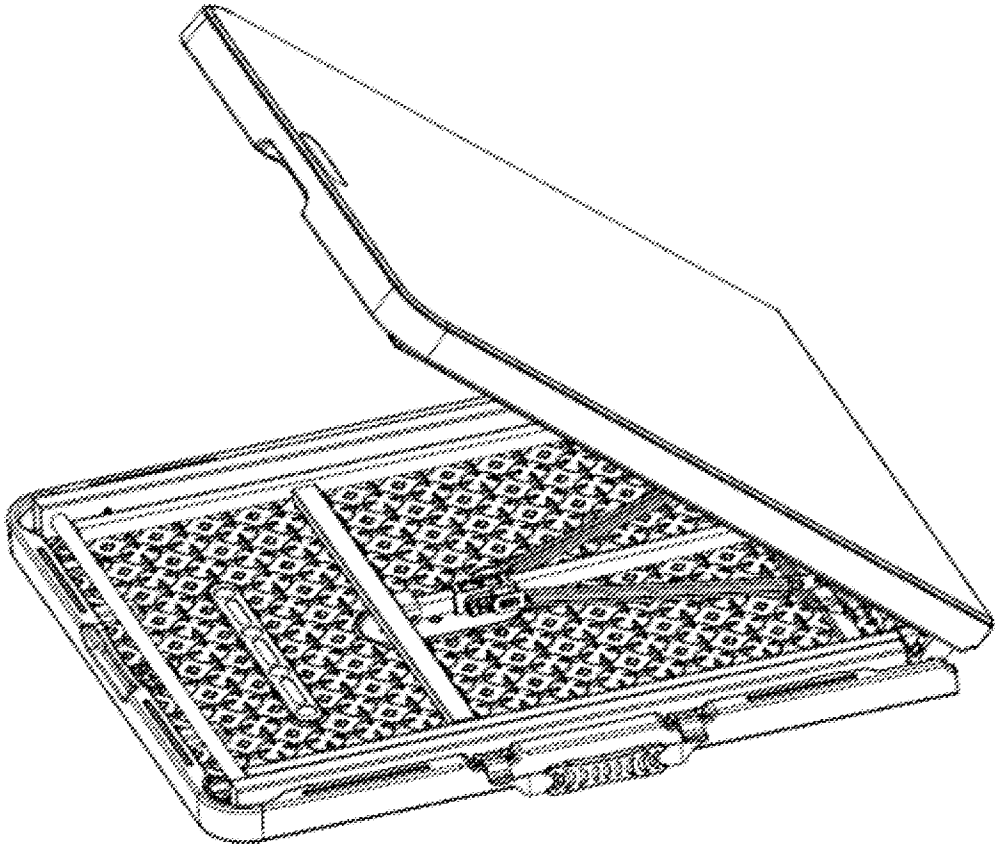
Figure 5E:
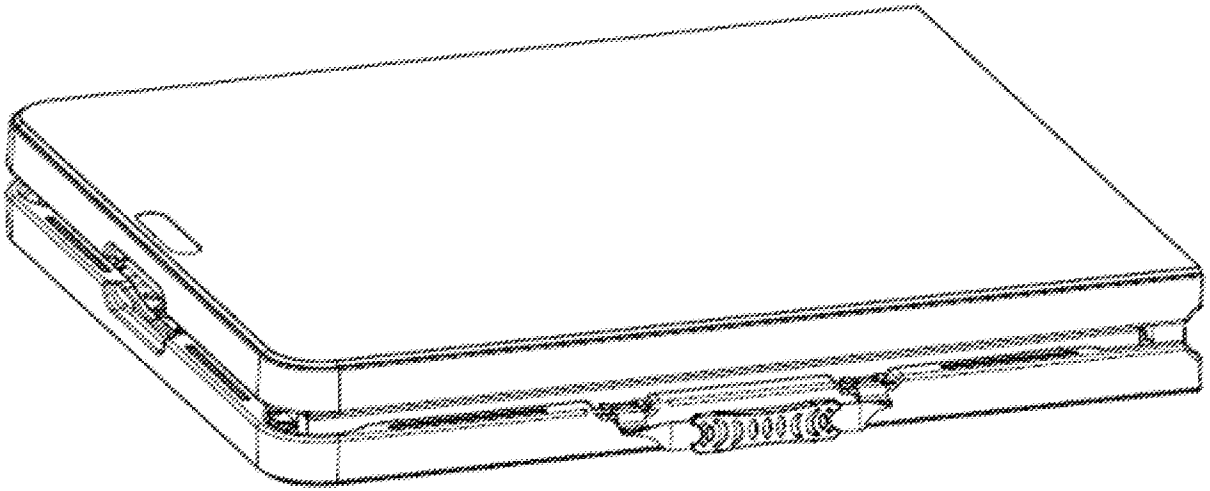
Figure 5F:
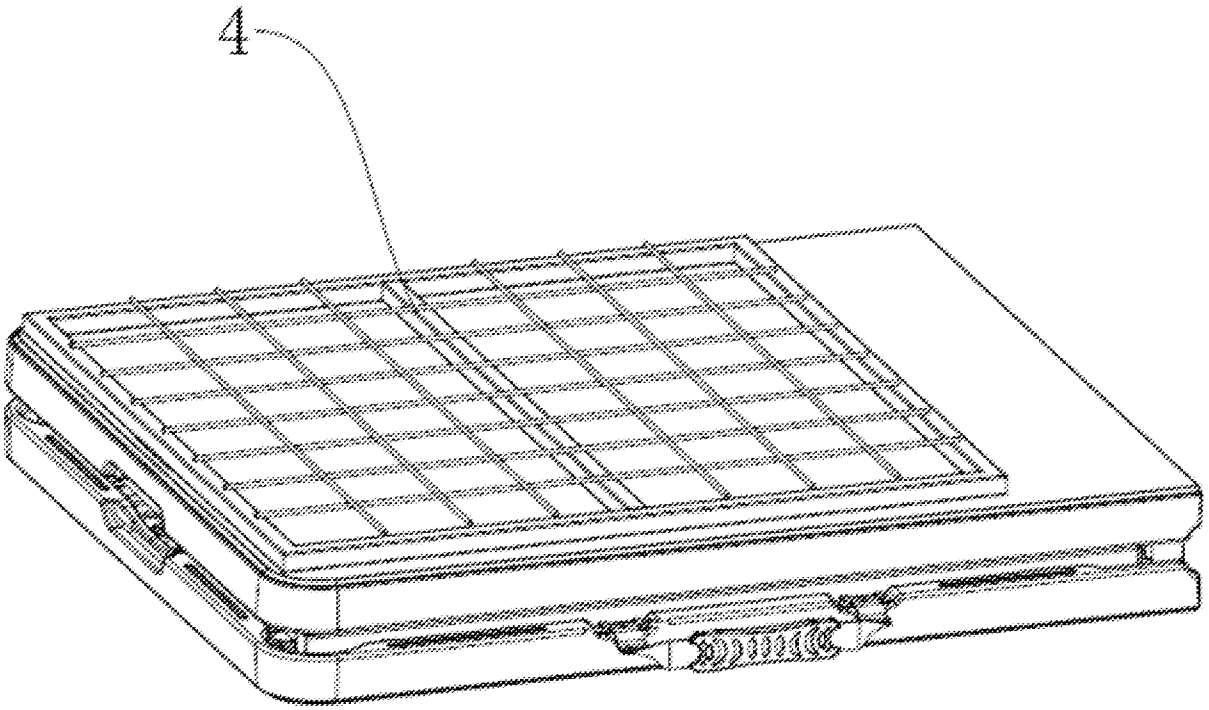

The pivotal connection of first mounting unit a1 and second mounting unit a2 allows them to rotate with respect to each other between a folded position, such as that illustrated in FIG. 5E, and an unfolded position, such as that illustrated in FIG. 1 or FIG. 4A. In some exemplary embodiments, c2 includes a locking/unlocking mechanism, such as controller c3, illustrated in FIG. 5A, to lock or unlock the first and second mounting units. Examples of such connectors are disclosed in U.S. patent application Ser. No. 16/838,939 (now U.S. Pat. No. 10,863,819 B1), and U.S. patent application Ser. No. 17/368,284, the disclosure of each application is incorporated herein for all purposes by reference in its entirety.

In some exemplary embodiments, the first or second mounting unit includes a first longitudinal mounting member, such as longitudinal mounting member a11 in the front side of FIG. 2A, and a second longitudinal mounting member, such as longitudinal mounting member a11 in the rear side of FIG. 2A. The first and second longitudinal mounting members are spaced apart from each other, for instance, in the y-direction of FIG. 1. In some exemplary embodiments, each of the first and second mounting units includes the first and second longitudinal mounting members.

Longitudinal mounting member a11 has a length that is adjustable in the longitudinal direction (e.g., x-direction of FIG. 1). For instance, in some exemplary embodiments, longitudinal mounting member a11 includes a first elongated member, such as elongated member b1, and a second elongated member, such as elongated member b2. The first and second elongated members are telescopically coupled with each other. This allows the first or second mounting unit to extend or contract in the longitudinal direction. As a result, the mounting assembly is adjustable between an extended state, such as that illustrated in FIG. 1, and a contracted state, such as that illustrated in FIG. 4A.

In some exemplary embodiments, longitudinal mounting member a11 also includes a first engaging member, such as engaging member s1, disposed at the first elongated member. For instance, in some exemplary embodiments, at least a portion of the first elongated member is tubular. One or more holes, such as hole b11, are formed on one or more sides of the first elongated member at or adjacent to a first end portion of the first elongated member. Corresponding to the one or more holes formed at the first elongated member, the first engaging member is formed with one or more protrusions, such as protrusion s11, on one or more sides of the first engaging member. When the first engaging member (or a portion of it) is inserted into the first end portion of the first elongated member, protrusion s11 is protruded out of hole b11, thereby fixedly coupling the first engaging member with the first elongated member.

In some exemplary embodiments, the first engaging member includes a slot, such as slot s13, that matches, cross-sectional-wise, the second elongated member to guide telescopic movement of the second elongated member with respect to the first elongated member (e.g., cross-sectional-wise, the slot has the same or similar shape as the second elongated member). In some exemplary embodiments, the second elongated member includes a rail portion, such as rail portion b22, and a bearing portion, such as bearing portion b21. In an exemplary embodiment, cross-sectional-wise, the railing and bearing portions collectively form a substantially "L" shape.

In some exemplary embodiments, longitudinal mounting member a11 further includes a second engaging member, such as engaging member b23, disposed at the second elongated member to define the maximal allowable extension of the longitudinal mounting member. For instance, as longitudinal mounting member a11 extends, i.e., as the second elongated member moving away from the first elongated member, the second engaging member disposed at the second elongated member approaches the first engaging member disposed at the first elongated member. When the second engaging member contacts the first engaging member, e.g., blocking surface s14 of the first engaging member, and the second engaging member abuts the first engaging member and thus prevents the second elongated member from moving further away from the first elongated member. In other words, when engaged, the first and second engaging members prevents longitudinal mounting member a11 from extending beyond a defined maximal allowable length of longitudinal mounting member a11.

In an exemplary embodiment, the second engaging member is disposed at the bearing portion of the second elongated member. In some exemplary embodiments, the second engaging member is a bolt, a screw, or the like fastened on the second elongated member.

In some exemplary embodiments, longitudinal mounting member a11 further includes a third engaging member, such as engaging member b24. The third engaging member is disposed at the second elongated member to help smooth telescopic movement of the second elongated member with respect to the first elongated member. In an exemplary embodiment, the third engaging member is disposed at an end portion of the second elongated member. In some exemplary embodiments, cross-sectional-wise, the third engaging member matches generally the interior of the firth elongated member.

In some exemplary embodiments, the first longitudinal mounting members (e.g., mounting members a11 on the front side of FIG. 2A) of first mounting unit a1 and second mounting unit a2 are pivotally coupled with each other at their proximal end portions (e.g., the middle of FIG. 2A). Similarly, the second longitudinal mounting members (e.g., mounting members a11 on the rear side of FIG. 2A) of first mounting unit a1 and second mounting unit a2 are pivotally coupled with each other at their proximal end portions, for instance.

It should be noted that in embodiments where a longitudinal mounting member includes first and second elongated members, the longitudinal mounting members of the first and second mounting units can be oriented in various ways, and either the first or second elongated member of the longitudinal mounting member of the first mounting unit can be connected to either the first or second elongated member of the longitudinal mounting member of the second mounting unit. For instance, the longitudinal mounting members of the first and second mounting units can be oriented such that the first elongated members of the first unit and the second elongated members of the second mounting unit are disposed in the middle section of the mounting assembly and connected to each other. The longitudinal mounting members of the first and second mounting units can also be oriented such that the first elongated members of the first unit and the first elongated members of the second mounting unit are disposed in the middle section of the mounting assembly and connected to each other. The longitudinal mounting members of the first and second mounting units can further be oriented such that the second elongated members of the first unit and the first elongated members of the second mounting unit are disposed in the middle section of the mounting assembly and connected to each other. In addition, the longitudinal mounting members of the first and second mounting units can further be oriented such that the second elongated members of the first unit and the second elongated members of the second mounting unit are disposed in the middle section of the mounting assembly and connected to each other, as illustrated in FIG. 1. In some exemplary embodiments, an end portion of the second engaging member of the first or second longitudinal mounting member of the first mounting unit is pivotally connected to an end portion of the second engaging member of the first or second longitudinal mounting member of the second mounting unit Supporting frame 2 also includes a plurality of leg assemblies, such as leg assembly 22. The plurality of leg assemblies are connected to the mounting assembly and configured to support the mounting assembly above the ground. In some exemplary embodiments, the plurality of leg assemblies includes a first leg assembly (e.g., the leg assembly on the right side of FIG. 1) connected to first mounting unit a1 and a second leg assembly (e.g., the leg assembly on the left side of FIG. 1) connected to second mounting unit a2. The first and second leg assemblies can be but do not necessarily have to be identical or symmetric with respect to each other. By way of example, FIG. 1 illustrates the first and second leg assemblies that are substantially the same and disposed symmetrically with respect to each other.

In some exemplary embodiments, the first leg assembly is rotatable with respect to the first and second longitudinal mounting members of the first mounting unit. For instance, in some exemplary embodiments, the first mounting unit includes a lateral mounting member, such as lateral mounting a12. The lateral mounting member has an end portion rotatably coupled with a distal end portion of the first longitudinal mounting member of the first mounting unit, and another end portion rotatably coupled with a distal end portion of the second longitudinal mounting member of the first mounting unit. The first leg assembly is connected to the lateral mounting member, and thus also rotatable with respect to the first and second longitudinal mounting members of the first mounting unit.

Similarly, in some exemplary embodiments, the second leg assembly is rotatable with respect to the first and second longitudinal mounting members of the second mounting unit, for instance, through a lateral mounting member rotatably coupled with distal end portions of the first and second longitudinal mounting members of the second mounting unit.

In some exemplary embodiments, the plurality of leg assemblies includes a third leg assembly (e.g., the leg assembly in the middle) connected to the mounting assembly and configured to help supporting the mounting assembly above the ground and/or enhances the stability of the supporting frame. For instance, in some exemplary embodiments, the mounting assembly further includes an interior lateral mounting member, such as interior lateral mounting member c. The interior lateral mounting member is connected to the first and second longitudinal mounting members of the first or second mounting unit at the proximal end portions, for instance, through connector c2. The third leg assembly is connected to interior lateral mounting member c1. In an exemplary embodiment, interior lateral mounting member c1 is connected to connector c2 that pivotally connects first mounting unit a1 (e.g., longitudinal mounting member a11 of the first mounting unit) and second mounting unit a2 (e.g., longitudinal mounting member a11 of the second mounting unit). This allows the first and second mounting units to rotate relative to each other and relative to the third leg assembly.

The supporting frame can include additional, optional and/or alternative components. For instance, referring in particular to FIGS. 2A, 5A and 5B, in some exemplary embodiments, the supporting frame includes additionally or optionally a first supporting assembly, such as supporting assembly 3 on the right side of FIG. 5A, and a second supporting assembly, such as supporting assembly 3 on the left side of FIG. 5A. The first and second supporting assemblies can be but do not necessarily have to be identical or symmetric with respect to each other. By way of example, the first and second supporting assemblies are illustrated to be substantially the same. The first supporting assembly is pivotally coupled with the first leg assembly and the first mounting unit to help control the rotation of the first leg assembly and/or lock the first leg assembly when the supporting frame or structure is in use. The second supporting assembly is pivotally coupled with the second leg assembly and the second mounting assembly to help control the rotation of the second leg assembly and/or lock the second leg assembly when the supporting frame or structure is in use.

For instance, in some exemplary embodiments, supporting assembly 3 includes a first supporting member, such as first supporting member 31, at least one second supporting member, such as second supporting member 32, and a sliding mechanism, such as sliding mechanism 33. One end portion of the first supporting member is pivotally coupled with the first or second leg assembly, for instance, pivotally coupled with leg lateral bar 221 of the first or second leg assembly. One end portion of the second supporting member is coupled with the first supporting member, for instance, through the sliding mechanism. The other end portion of the second supporting member is pivotally coupled with lateral mounting member a13, which in turn is connected to the first and second longitudinal mounting members of the first or second mounting unit. In some exemplary embodiments, the supporting assembly is configured the same as or similar to those disclosed in U.S. patent application Ser. No. 16/838,939 (now U.S. Pat. No. 10,863,819 B1), U.S. patent application Ser. No. 16/951,461, U.S. patent application Ser. No. 17/368,284, U.S. patent application Ser. No. 17/583,037, and U.S. patent application Ser. No. 17/583,087, the disclosure of each application is incorporated herein for all purposes by reference in its entirety.

In some exemplary embodiments, panel assembly 1 includes a first panel, such as panel 21, and a second panel, such as panel 22 connected to the supporting frame. The first and second panel can be but do not necessarily have to be identical or symmetric with respect to each other. By way of example, FIG. 1 illustrates the first and second panels that are substantially the same and disposed symmetrically with respect to each other. In some exemplary embodiments, the first panel is coupled with the first mounting unit and the second panel is coupled with the second mounting unit.

In some exemplary embodiments, each of the first and second panels is a unitary piece formed by blow molding plastics such as high density polyethylene (HDPE), low density polyethylene (LDPE), polypropylene (PP), polyvinyl chloride (PVC), polyethylene terephthalate (PET), thermoplastic elastomers (TPE), or the like. The panel generally includes a first panel wall, a second panel wall and a generally hollow interior formed between the first and second panel walls. The panel can be of various regular or irregular shapes, including but not limited to a square shape, a half circular shape or a rectangular shape. The panel can have other features, such as depressions, ridges, or the like, monolithically formed with the first and/or second panel walls.

In some exemplary embodiments, panel assembly 1 also includes one or more third panels, such as panel 4, that are configured to be detachably coupled with the mounting assembly when it is extended. In some exemplary embodiments, a third panel is configured to be detachably coupled with the first and second mounting units between the first and second panels when the mounting assembly is extended. In an exemplary embodiment, third panel is configured to be detachably coupled with the second elongated members of the first and/or second mounting units when the mounting assembly is extended. A third panel can be but do not necessarily have to be identical to the first panel, second panel, or another third panel. For instance, as a non-limiting example, FIGS. 1 and 2A illustrate panel 4 that differs from the first and second panels in size and appearance. In an exemplary embodiment, panel 4 is a mesh panel.

The supporting frame and structure disclosed herein are easy to use and convenient to carry around. For instance, referring to FIGS. 4A-4E, when a relatively larger usable area is needed or desired, a user can pull mounting assembly 21 to move telescopically second elongated member b2 away from first elongated member b1 until second engaging member b23 interacts with first engaging member s1 and thus prevents further extension of the mounting assembly. Once the mounting assembly is extended, the user can simply place third panel 4 on the extended mounting assembly between first panel 11 and second panel 12. No fastening is necessarily. If restoring to its original state is desired, the user can remove third panel 4 from the extended mounting assembly and then push the mounting assembly to move telescopically the second elongated member toward the first elongated member until the mounting assembly is restored to its original state. As can be seen, extending and contracting the supporting frame and structure is very simple and easy. In addition, aided by the first and third engaging members, extending and contracting the supporting frame and structure is also very smooth.

In some exemplary embodiments, the first panel is connected to the first mounting unit, and the second panel is connected to the second mounting unit. Moreover, the first mounting unit is substantially the same as the second mounting unit and the first panel is substantially the same as the second panel. Further, the first and second mounting units are pivotally connected to each other at their proximal end portions. In such exemplary embodiments, the supporting structure can be folded substantially in half. An exemplary folding process is illustrated in FIGS. 5A-5F. As shown, once the mounting assembly is contracted, the user can fold the first leg assembly toward the first mounting unit and fold the second leg assembly toward the second mounting unit. Once the first and second leg assemblies are folded, the user can fold the first and second mounting units, along with the first and second panels, toward each other. When folded, the first and second mounting units, the first, second and third leg assemblies, and the additional/optional first and second supporting units are disposed in between the first and second panels. As such, the folded structure is compact and convenient to carry around. Reversing the process will unfold the structure.

The supporting frames and structures (e.g., tables) of the present disclosure have several advantages. With the extendable mounting assembly, a supporting frame/structure of the present disclosure can provide different usable areas to accommodate different situations and meet user's different needs. With the additional third leg assembly, the supporting frame/structure of the present disclosure is more stable and safer when in use. The supporting frame/structure is compact when unfolded, and accordingly, is easy to carry around.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first portion could be termed a second portion, and, similarly, a second portion could be termed a first portion, without changing the meaning of the description, so long as all occurrences of the "first portion" are renamed consistently and all occurrences of the "second portion" are renamed consistently.

What is claimed is:

1. A supporting frame, comprising:

a mounting assembly comprising a first mounting unit and a second mounting unit, wherein:

each of the first and second mounting units comprises a first longitudinal mounting member and a second longitudinal mounting member spaced apart from each other in a first direction;

each of the first and second longitudinal mounting members of the first and second mounting units has a length that is adjustable in a second direction, thereby allowing the mounting assembly to extend or contract in the second direction; and the first longitudinal mounting members of the first and second mounting units are pivotally coupled with each other at proximal end portions thereof and the second longitudinal mounting members of the first and second mounting units are pivotally coupled with each other at proximal end portions thereof, thereby allowing the first and second mounting units to rotate relative to each other between a folded position and an unfolded position; and a plurality of leg assemblies, each connected to the mounting assembly and rotatable relative to the first and second longitudinal mounting members of the first or second mounting unit, thereby allowing the mounting assembly and the plurality of leg assemblies to fold onto each other, wherein the supporting frame is extendable and foldable.

2. The supporting frame of claim 1, wherein each respective longitudinal mounting member in the first and second longitudinal mounting members of the first and second mounting units comprises:

a first elongated member and a second elongated member telescopically coupled with each other.

3. The supporting frame of claim 2, wherein each respective longitudinal mounting member further comprises:

a first engaging member disposed at the first elongated member; and a second engaging member disposed at the second elongated member, wherein when engaged with each other, the first and second engaging members collectively prevent the respective longitudinal mounting member from extending beyond a defined maximal allowable length of the respective longitudinal mounting member.

4. The supporting frame of claim 3, wherein:

at least a portion of the first elongated member is tubular; and the first engaging member is connected to a first end portion of the first elongated member, wherein the first engaging member comprises a slot matching, cross-sectional-wise, the second elongated member to guide telescopic movement of the second elongated member with respect to the first elongated member.

5. The supporting frame of claim 4, wherein an end portion of the second elongated member of the first or second longitudinal mounting member of the first mounting unit is pivotally connected to an end portion of the second elongated member of the first or second longitudinal mounting member of the second mounting unit.

6. The supporting frame of claim 4, wherein the second elongated member comprises a rail portion and a bearing portion.

7. The supporting frame of claim 6, wherein cross-sectional-wise, the railing and bearing portions collectively form a substantially "L" shape.

8. The supporting frame of claim 6, wherein the second engaging member is disposed at the bearing portion of the second elongated member.

9. The supporting frame of claim 1, wherein the plurality of leg assembles comprises:

a first leg assembly connected to the first mounting unit and rotatable with respect to the first and second longitudinal mounting members of the first mounting unit; and a second leg assembly connected to the second mounting unit and rotatable with respect to the first and second longitudinal mounting members of the second mounting unit.

10. The supporting frame of claim 9, wherein:

each of the first and second mounting units further comprises a lateral mounting member rotatably connected to the first and second longitudinal mounting members of the first or second mounting unit at distal end portions thereof;

the first or second leg assembly is connected to the lateral mounting member of the first or second mounting unit.

11. The supporting frame of claim 9, wherein:

the mounting assembly further comprises an interior lateral mounting member connected to the first and second longitudinal mounting members of the first or second mounting unit at proximal end portions thereof; and the plurality of leg assemblies further comprises a third leg assembly connected to the interior lateral mounting member.

12. A supporting structure, comprising:

the supporting frame of claim 1;

a first panel coupled with the first mounting unit; and a second panel coupled with the second mounting unit.

13. A supporting frame, comprising:

a mounting assembly comprising a first mounting unit and a second mounting unit pivotally connected to each other at proximal sides thereof, thereby allowing the first and second mounting units to rotate relative to each other between a folded position and an unfolded position, wherein:

each of the first and second mounting units comprises a first mounting member and a second mounting member spaced apart from each other in a first direction;

for at least one mounting unit in the first and second mounting units, each of the first and second mounting members comprises:

a first elongated member;

a second elongated member telescopically coupled with the first elongated member to adjust a length of the first or second mounting member in a second direction, thereby allowing the mounting assembly to extend or contract in the second direction;

a first engaging member disposed at the first elongated member and configured to guide telescopic movement of the second elongated member relative to the first elongated member; and a second engaging member disposed at the second elongated member and configured to engage with the first engaging member to prevent the first or second mounting member from extending beyond a defined maximal allowable length of the first or second mounting member.

14. The supporting frame of claim 13, wherein:

at least a portion of the first elongated member is tubular; and the first engaging member is connected to a first end portion of the first elongated member, wherein the first engaging member comprises a slot matching, cross-sectional-wise, the second elongated member to guide telescopic movement of the second elongated member relative to the first elongated member.

15. The supporting frame of claim 14, wherein:

each of the first and second mounting members of the first and second mounting units comprises the first and second elongated members; and an end portion of the second engaging member of the first or second longitudinal mounting member of the first mounting unit is pivotally connected to an end portion of the second engaging member of the first or second longitudinal mounting member of the second mounting unit.

16. The supporting frame of claim 15, wherein the second elongated member comprises a rail portion and a bearing portion, wherein cross-sectional-wise, the railing and bearing portions collectively form a substantially "L" shape.

17. A supporting structure, comprising:

the supporting frame of claim 13;

a first panel coupled with the first mounting unit; and a second panel coupled with the second mounting unit.

18. A supporting structure, comprising:

a mounting assembly comprising a first mounting unit and a second mounting unit, wherein:

each of the first and second mounting units comprises a first longitudinal mounting member and a second longitudinal mounting member spaced apart from each other in a first direction;

each of the first and second longitudinal mounting members of the first and second mounting units has a length that is adjustable in a second direction, thereby allowing the mounting assembly to extend or contract in the second direction; and the first longitudinal mounting members of the first and second mounting units are pivotally coupled with each other at proximal end portions thereof and the second longitudinal mounting members of the first and second mounting units are pivotally coupled with each other at proximal end portions thereof, thereby allowing the first and second mounting units to rotate relative to each other between a folded position and an unfolded position;

a plurality of leg assemblies, each connected to the mounting assembly and rotatable relative to the first and second longitudinal mounting members of the first or second mounting unit;

a first panel coupled with the first mounting unit; and a second panel coupled with the second mounting unit, wherein the supporting structure is extendable and foldable, and when folded, the mounting assembly and the plurality of leg assemblies are disposed between the first and second panels.

19. The supporting structure of claim 18, wherein the first mounting unit is substantially the same as the second mounting unit and the first panel is substantially the same as the second panel, thereby allowing the supporting structure to fold substantially in half.

20. The supporting structure of claim 18, further comprising:

a third panel detachably coupled with the first and second mounting units between the first and second panels when the mounting assembly is extended.

* * * * *